United States Patent [19]

Cheek

[11] Patent Number: 4,612,987

[45] Date of Patent: Sep. 23, 1986

[54] DIRECTIONAL DRILLING AZIMUTH CONTROL SYSTEM

[76] Inventor: Alton E. Cheek, 1949 Vuelta Grande Ave., Long Beach, Calif. 90815

[21] Appl. No.: 767,627

[22] Filed: Aug. 20, 1985

[51] Int. Cl.[4] ..... E21B 23/00

[52] U.S. Cl. ..... 166/212; 175/325

[58] Field of Search ..... 166/212, 120; 175/325, 175/326, 97, 98, 99, 76, 230

[56] References Cited

U.S. PATENT DOCUMENTS

| | | | |
|---|---|---|---|
| 2,796,234 | 6/1957 | Mann | 175/76 |
| 4,154,310 | 5/1979 | Konstantinovsky | 175/99 |
| 4,377,207 | 3/1983 | Kofahl | 175/99 |

*Primary Examiner*—James A. Leppink
*Assistant Examiner*—Terry Lee Melius
*Attorney, Agent, or Firm*—Albert L. Gabriel

[57] ABSTRACT

According to the invention, a downhole anchor assembly is employed for absorbing reaction torque from a downhole mud motor in a directional drill string so as to minimize azimuthal deviation from such reaction torque. The anchor assembly has as its main structural basis an elongated, generally cylindrical housing with upper and lower ends formed as tool joints for coupling the body into a directional drill string. Three elongated chain support bodies are longitudinally mounted in the housing, evenly circumferentially spaced about the periphery, and each support body supports an endless anchor block chain so that elongated portions of the chains are longitudinally arranged and generally radially exposed externally of the bodies. The chain support bodies are radially shiftable under the influence of hydraulic drilling fluid pressure from retracted positions in the body to extended positions in which the exposed chain portions grip the well casing against twisting of the drill string.

19 Claims, 10 Drawing Figures

DIRECTIONAL DRILLING AZIMUTH CONTROL SYSTEM

BACKGROUND OF THE INVENTION

1. Field of the Invention

The present invention relates to downhole anchor devices for use in eliminating the effects of reactive torque in directional drilling procedures.

2. Description of the Prior Art

Directional drilling is widely utilized today for the efficient exploitation of oil and gas fields, but requires great accuracy in drill orientation as to both azimuth and inclination or drift angle.

Straight sections of the bore are drilled with a simple rotary drill, and required alterations in the direction of the bore are achieved using a downhole mud motor drill of either the positive displacement or turbine type which is offset at a small angle relative to the drill string axis by means of a bent sub. The bent sub causes the drill to follow a path which curves away from the straight section of the bore above it, and steering is accomplished by rotation of the drill pipe at the surface to the desired azimuthal orientation of the bent section. The amount of deflection or inclination from the straight section of bore above is determined by the length of the curved path that is followed by the drill at the desired azimuth.

Once the downhole mud motor drill introduces a deviation from the vertical section of bore, however, reaction torque from the torque exerted on the drill bit by the mud motor is transmitted to the drill string and begins to force the drill bit away from its desired azimuthal orientation. So far, response to this difficulty has developed several survey instruments that are lowered on wirelines down the drill string to monitor changes in azimuth and inclination of the drill bit, relaying such information to a surface readout to enable correction at the surface. These devices are extremely expensive (currently $20,000 to $50,000 per job inside the U.S.A. and $50,000 to $100,000 per job elsewhere) and incur further costs due to the necessity of tripping them in and out of the drill string in order to add sections of drill pipe to the top of the drill string. The wireline companies make charges per foot of bore depth for each round trip of the wireline plus hourly rates for the truck, operator and a helper. Tripping of the wireline into and back out of the drill string at a depth, for example, of 5,000 feet sets drilling time back approximately 2½ to 3 hours. Considering daily charges made by the companies providing the survey and readout equipment as well as the daily rate of the directional drilling company, the problem of reactive torque and consequent azimuthal drift of the drill bit rapidly becomes an insupportable financial burden.

The only device of which applicant is aware that is currently employed for the reduction of azimuthal drift is the kelly, which tool loses most of its efficacy by being located on the surface. The kelly attempts to eliminate such drift by gripping the top of the drill string against rotation. This allows reactive torque to twist or wind up the entire length of the drill string below the surface, which can extend for thousands of feet. In addition, the kelly restricts the depth which may be drilled in one operation. Most drilling operations have the capacity of drilling a 90-foot stand of drill pipe at one time. The kelly, however, requires that singles, or 30-foot sections of drill pipe, be separately added and drilled in order to regrip the drill string adequately. Since the kelly has little effect in reducing azimuthal drift, it does nothing to reduce the number of wireline trips required by the survey instrumentation or the cost thereby incurred.

Applicant is not aware of any prior art device or method that will adequately absorb reactive torque near its source downhole. In particular, applicant is not aware of any prior art device or method that will completely absorb reactive torque near its source downhole and positively prevent rotational travel or twisting of the drill string and hence positively prevent azimuthal drift in directional drilling, while at the same time allowing free, unrestrained axial movement of the drill string.

Applicant is aware of a number of prior art patents which disclose well drilling apparatus in which rollable wheels engage the wall of a well and are oriented so as to travel axially along the well as drilling occurs. These include U.S. Pat. Nos. to Karns 879,822, Wittich 969,233, Maher et al. 1,072,964, Blackwell 1,350,059, Mann 2,796,234, Brown 3,249,162, and Werner 3,729,057, and also French Pat. No. 2,275,633 to Bonet-Thirion. Most of these wheels are employed simply for alignment or stabilizing purposes. Only the Maher et al. and Brown disclosures show an intention that the wheels prevent rotational movement of the drilling tool in the well, but the tools of both Maher et al. and Brown are suspended in the well, on a cable in Maher et al. and on a tube rolled up on a surface drum in Brown. Neither of the suspended Maher et al. and Brown tools could possibly be used for directional drilling because directional drilling requires use of a conventional drill string in order to establish the desired azimuthal direction of the bent sub near the bottom of the string used to establish and achieve the desired azimuthal direction of drilling.

Although Maher et al. and Brown disclose the purpose of axially rolling wheels to be the prevention of rotation of the drilling tool, applicant has found by means of extensive testing that it is impossible to prevent rotational travel and deflection of portions of a drill string near its downhole end with rollable anchor devices such as wheels, even though the wheels are numerous and have specially designed serrated gripping peripheries specifically intended to prevent rotational travel of the drill string. Even a small amount of rotational travel and deflection of a directional drilling string near its downhole end will cause a major amount of horizontal offset of the directional bore as drilling proceeds further and further from the initial, usually vertical shaft. This is intolerable in directional drilling procedures. Applicant believes the reason gripping wheels are unable to prevent rotational travel and deflection as drilling proceeds is the moving or dynamic nature of the contact between the wheels and the well bore. With continuous downward movement of the drill string, the wheels are continuously moving from point to point along the wall of the well and are never at rest or staticaly located, and therefore are never able to obtain a fixed lock against the well wall. This is particularly the case where the wheels are engaged against a well casing, in which case the contact of the wheels against the casing is essentially a point or transverse line contact. This is an insufficient purchase for preventing rotational travel and deflection under the high reaction torque produced during directional drilling with a downhole hydraulic fluid or mud motor.

Applicant is aware of three prior art patents which disclose attempts to prevent rotation of a drilling tool under the influence of reaction torque by a static type of device. These are U.S. Pat. Nos. 1,112,946 to Turnbull, Taylor 1,870,697, and French Pat. No. 1,271,163 to Allard. In Turnbull, four solenoid armatures are projected magnetically outwardly into engagement with a metal casing wall, and the concept was that these would allow axial movement while resisting rotational movement. However, these solenoid armatures are just as slideable rotationally on the wall of the casing as they are axially, so that rotational travel would be inevitable under the influence of reaction torque. Taylor discloses a pair of axially serrated grippers pivotal outwardly into gripping engagement with the well bore under the influence of hydraulic pressure when a weighted upper part of the tool is released downwardly relative to the lower part of the tool in which the gripping members are mounted, which actuates a hydraulic cylinder to provide the necessary hydraulic pressure. The problem with this device is that the grippers are dovetailed to the tool for sliding movement, and this only allows a relatively short increment of travel of the drilling tool until drilling must be stopped, the grippers released by pulling upwardly on the weighted part of the tool, allowing the gripping members to slide downwardly in the dovetail tracks to a new position at which the tool can then be reactivated. Such repeated disengagement after short increments of drilling travel would cause azimuthal orientation to be lost in directional drilling. Additionally, the tools of both Turnbull and Taylor are cable suspended and hence could not possibly be used in directional drilling.

The underreamer apparatus in French Pat. No. 1,271,163 to Allard has the same deficiencies as the Turnbull device. Allard discloses pads hydraulically compressed against the wall of a well casing, with the apparatus like Turnbull being suspended on a cable and hence unusable in directional drilling. The gripping pads appear to be intended to secure the Allard tool against both axial and rotational movement, but if they were axially slideable in operation, they would necessarily also be rotationally slideable as for the apparatus disclosed in Turnbull.

SUMMARY OF THE INVENTION

In view of these and other problems in the art, it is an object of the present invention to provide an anchor system near the downhole end of a directional drill string for positively gripping a well casing against rotational travel and twisting of the lower end portion of the drill string which would otherwise cause azimuthal drift, while nevertheless allowing unrestrained axial movement along the well bore.

Another object of the invention is to provide a downhole anchor system for a directional drill string which, by positively locking the drill string against twisting from reactive torque and thereby positively maintaining azimuthal direction control, eliminates much of the expense and delay incurred by the use of downhole azimuthal survey instruments.

Another object of the invention is to provide a downhole anchor system for directional drill strings which, by employing a plurality of longitudinally oriented, circumferentially spaced endless anchor block chains, enables a static, biting grip to be achieved over an extended length of the tool to positively prevent any rotational travel of the tool, while at the same time allowing freedom of longitudinal travel of the tool, thereby avoiding the inevitable rotational travel and drill string twisting associated with the continuously moving dynamic contact which occurred when rotating wheels have been engaged against the casing wall in prior attempts by applicant to secure directional drill strings against azimuthal drift caused by reactive torque.

An additional object of the invention is to provide a downhole traveling anchor system for a directional drill string of the type employing a downhole mud motor, the anchor system being hydraulically operable by the same hydraulic fluid which drives the mud motor so as to be self-adjusting in that as reactive torque from the mud motor increases upon increase of the hydraulic pressure, so does the gripping force exerted on the casing wall by the anchor system.

According to the invention, an anchor assembly is interpolated into the drill string near the downhole end. The main housing structure of the anchor assembly is an anchor pipe having a centrally located enlarged section which serves as the anchor housing. Three elongated, longitudinally arranged chain housings are set into longitudinal troughs evenly circumferentially spaced around the perimeter of the enlarged anchor housing. These chain housings support longitudinally arranged, endless block chains (bicycle-type chains) in chain tracks which expose long lengths of the chains radially outwardly of the anchor assembly. The chain support bodies and their respective chains are radially extensible relative to the anchor housing by means of a series of hydraulically actuated pistons located in hydraulic cylinders which communicate with an axial fluid circulation hole in the anchor pipe through which the hydraulic drilling fluid passes to the downhole mud motor. Hydraulic pressure in the drilling fluid or mud which drives the downhole mud motor concurrently actuates the pistons and chain support bodies radially outward to produce a positive grip of the chains against the well casing against any rotational travel and twisting of the drill string that otherwise would be caused by reaction torque of the mud motor during drilling, thereby positively locking the lower end portion of the drill string against azimuthal drift during directional drilling. As increases in reaction torque occur with increases in drilling fluid pressure, a substantially proportionate increase in outward force of the chains against the casing also occurs to proportionately increase the locking force of the anchor assembly.

The grip of the long exposed portions of the endless block chains against the casing wall is a novel static grip over an extended length of the tool which, for the first time, does not allow any substantial twisting of a directional drilling tool despite relatively large amounts of reaction torque which occur from drilling with a downhole mud motor through difficult terrain.

BRIEF DESCRIPTION OF THE DRAWINGS

These and other objects of the present invention will become more apparent in reference to the following description and the accompanying drawings, wherein.

DETAILED DESCRIPTION OF THE INVENTION

Figure 1:
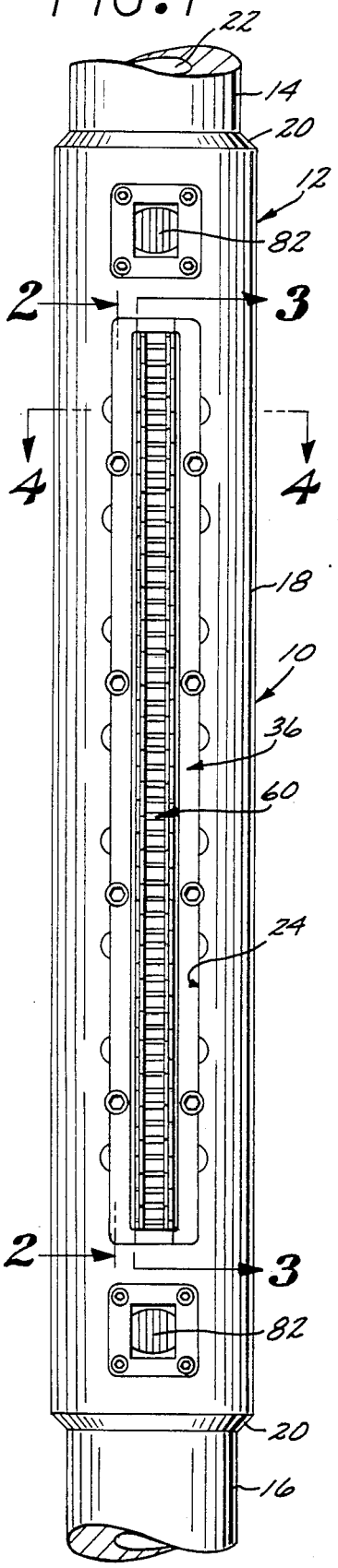
FIG. 1 is a fragmentary side elevational view of the traveling anchor assembly of the present invention in its retracted, unactuated condition.

Referring to the drawings, and at first particularly to FIGS. 1–5 thereof, the directional drilling azimuth control system of the invention employs a tubular anchor assembly generally designated 10 which is an elongated, pipe-like unit. The basic housing and support of anchor assembly 10 is an anchor pipe 12, which is preferably of unitary construction. Anchor pipe 12 has upper and lower coupling end sections 14 and 16, respectively, of a standard diameter for coupling into an oil or gas well drill string, end sections 14 and 16 terminating at their free ends in conventional tool joints.

Between the coupling end sections 14 and 16, and preferably generally centered along the length of the anchor pipe 12, is a radially enlarged anchor housing 18. The circumference of the anchor pipe 12 expands in an annular frustoconical guide chamfer 20 from each of the coupling end sections 14 and 16 to the respective end of the enlarged anchor housing 18. A fluid circulation passage 22 passes longitudinally through the center of anchor pipe 12 and is preferably of a diameter standard to oil and gas well drilling procedures, allowing the passage of hydraulic drilling fluid or mud through the anchor assembly 10.

Figure 2:
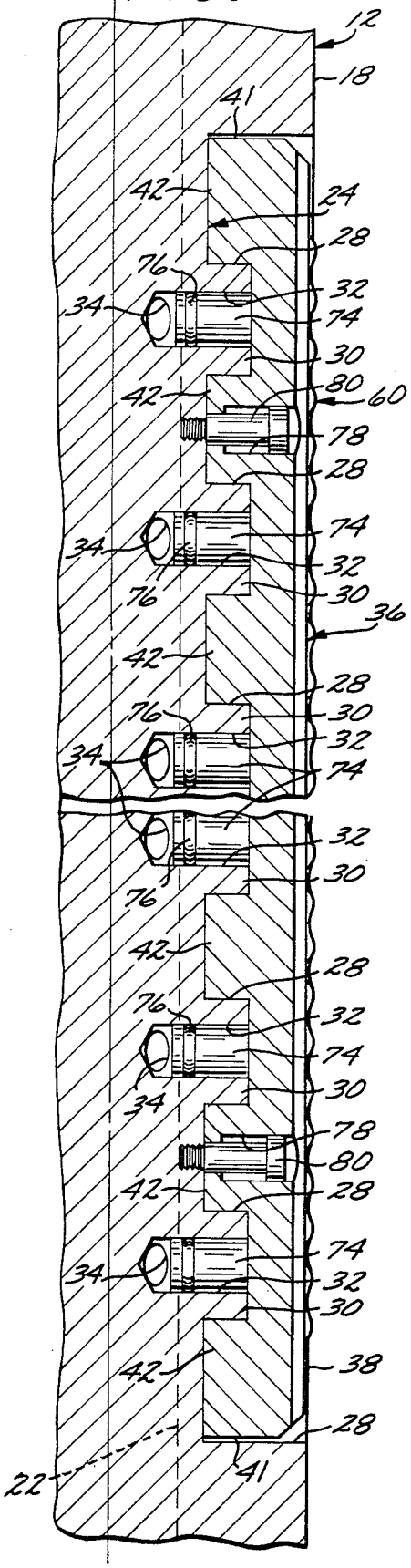
FIG. 2 is an enlarged, fragmentary, longitudinal section taken along line 2—2 in FIG. 1.
Figure 4:
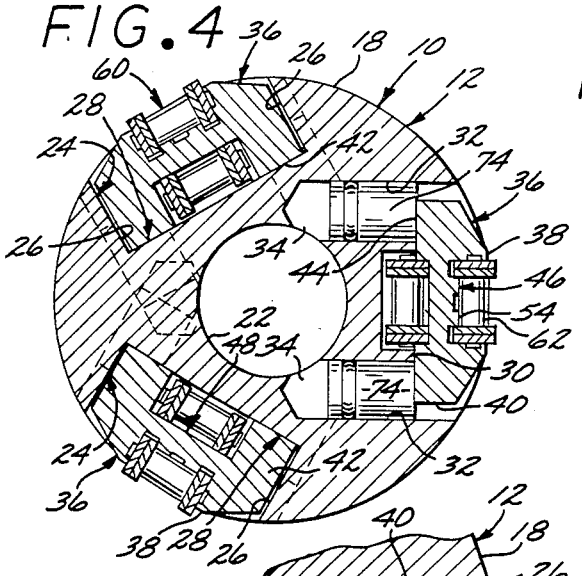
FIG. 4 is a transverse section taken along line 4—4 in FIG. 1.

Evenly circumferentially spaced around the periphery of the enlarged anchor housing 18 are three longitudinally arranged, radially opening troughs 24, each of which has a pair of parallel longitudinal side walls 26 and upper and lower end walls 27. The bottom of each of the longitudinal troughs 24 is stepped so as to provide a series of alternating radially inwardly extending guide recesses 28 and radially outwardly extending cylinder blocks 30. As best seen in FIGS. 2 and 4, each of the series of cylinder blocks 30 defines therein a pair of parallel, laterally spaced, generally radially oriented hydraulic cylinders 32, each of which is in fluid communication proximate its inner end with the central fluid circulation passage 22 through a fluid port 34. The pair of hydraulic cylinders 32 in each cylinder block 30 is located generally at opposite sides of the cylinder block and in registry longitudinally of the tool.

In order to avoid interference between the hydraulic cylinders 32 in the cylinder blocks 30 of any one of the three longitudinal troughs 24 with the hydraulic cylinders 32 of the cylinder blocks 30 of either of the other two longitudinal troughs 24, the locations of the three troughs 24 are longitudinally staggered relative to each other in the anchor housing 18. This then longitudinally offsets each pair of hydraulic cylinders 32 in each of the troughs 24 from the nearest pairs of hydraulic cylinders 32 in the other two longitudinal troughs 24. Such longitudinal offsetting of the hydraulic cylinders 32 is indicated in FIG. 4, wherein the cylinders 32 of the right-hand trough 24 are seen in cross-section, while the cylinders 32 of the other two troughs 24 are seen in dashed lines.

A radially outwardly opening longitudinal chain slot 35 is laterally centered in each of the three longitudinal troughs 24, cutting longitudinally through each of the cylinder blocks 30 between the respective pairs of hydraulic cylinders 32, with the bottom of chain slot 35 registering with the bottoms of the troughs 24.

Three elongated chain support bodies 36 are provided, each being fitted within a respective one of the three longitudinal troughs 24. Each of the chain support bodies 36 is slideable a short distance radially in its respective trough 24, but secured against longitudinal movement relative to the anchor housing 18. Each chain support body 36 has an elongated outer surface 38 along substantially its entire length and parallel to the outer surface of the anchor housing adjacent the respective longitudinal trough 24. Each chain support body 36 has a pair of elongated, flat, parallel side surfaces 40 extending the length of the body 36 and slideable in the generally radial direction relative to the respective side walls 26 of the trough 24. Each chain support body 36 has upper and lower ends 41 which are disposed adjacent the respective upper and lower end walls 27 of the respective trough 24.

Each of the elongated chain support bodies 36 has a sequence along its length of generally radially inwardly facing alternating guide projections 42 and cylinder block recesses 44. The guide projections 42 are generally radially slideably engaged within the respective guide recesses 28 of anchor housing 18, while the cylinder block recesses 44 generally radially slideably fit over the respective cylinder blocks 30. In the retracted condition of anchor assembly 10, the condition illustrated in FIGS. 2–5, the bottom surfaces of cylinder block recesses 44, which are flat surfaces, seat against complementary radially outwardly facing top surfaces of the respective cylinder blocks 30 and serve as piston engagement pads.

Each of the elongated chain support bodies 36 defines a track for an endless chain as follows. The body 36 has an outwardly opening outer longitudinal channel 46 laterally centered therein and extending along most of the length of the body 36. Each of the bodies 36 also has a radially inwardly opening inner longitudinal channel 48 laterally centered therein which is coextensive with the outer channel 46, extending along most of the length of the body 36. The upper ends of respective outer and inner longitudinal channels 46 and 48 are joined by an upper arcuate end recess 50, and the lower ends of respective outer and inner channels 46 and 48 are likewise joined by a lower arcuate end recess 50.

A pair of chain side plate grooves 52 is provided along the length of the outer longitudinal channel 46 in each chain support body 36 adjacent the side walls of the channel 46, and this leaves an outwardly facing straight, flat bearing track 54 along the length of each outer channel 46 to provide bearing support for rolling cylindrical block members of the chain. This bearing track 54 on each support body 36 may have a longitudinally arranged, laterally centered, outwardly facing lubrication groove 56 therein. Longitudinal pin grooves 58 extend along the lengths of both side walls of each chain track outer channel 46. The lateral pin grooves 58 provide clearance for the chain pins and positive location for the entire outwardly exposed length of the chain.

Figure 3:
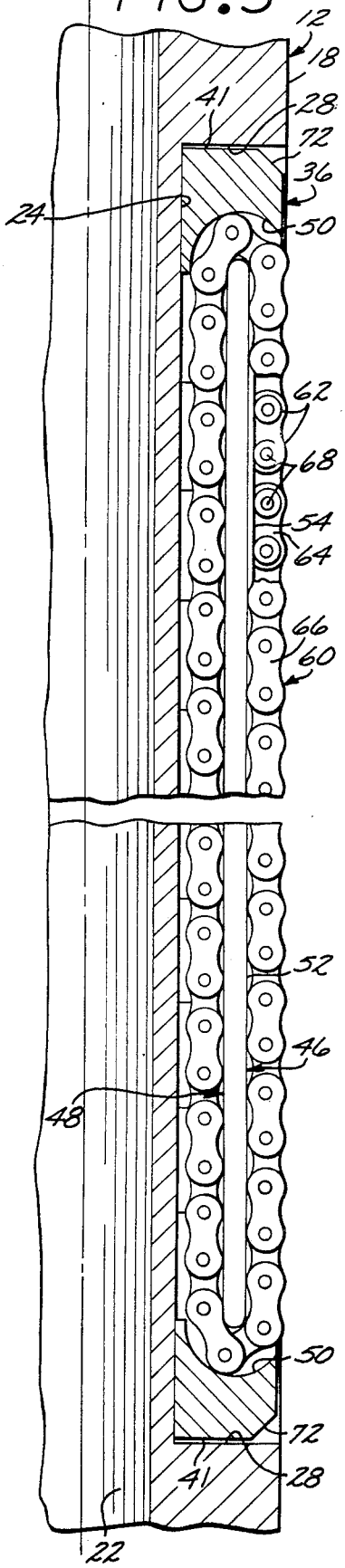
FIG. 3 is an enlarged, fragmentary, longitudinal section taken along line 3—3 in FIG. 1.
Figure 5:
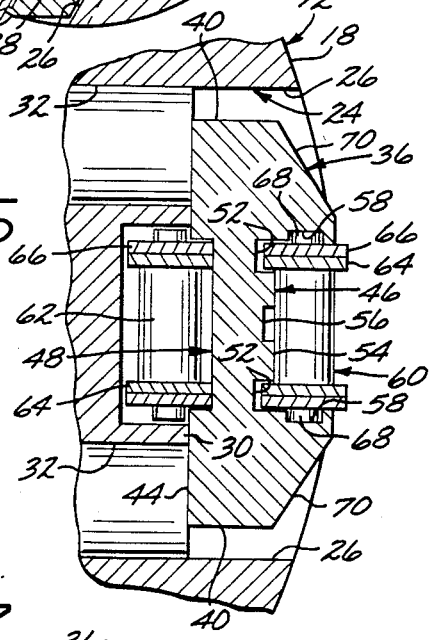
FIG. 5 is a further enlarged, fragmentary section showing a right-hand portion of the sectional view of FIG. 4.

An endless block chain (i.e., bicycle-type chain) 60 is slideably and rollably mounted in the chain track consisting of outer longitudinal channel 46, inner longitudinal channel 48, and arcuate end recesses 50. Details of the endless block chain 60 are best seen in FIGS. 3, 4 and 5. The chain 60 consists along its length of a sequence of transverse cylindrical blocks 62, overlapping inner and outer side plates or links 64 and 66, respectively, and pins 68 which hold the blocks 62 and side plates 64 and 66 together. This block chain construction of the endless chain 60 gives the chain 60 the necessary flexibility for it to flow through the arcuate end recesses 50 of the chain track, yet gives it great lateral stability. The transverse cylindrical blocks 62 are each freely rotatable on a respective one of the pins 68 so as to constitute rollable bearing members which freely roll along the outwardly facing bearing track 54 in the outer channel 46 of the chain track. Thus, with the chain support bodies 36 in their extended, gripping positions in which the radially outwardly exposed lengths of chains 60 are in gripping engagement against the casing wall, the cylindrical blocks 62 of chains 60 freely roll along the respective bearing tracks 54 despite compression of the chains between the support bodies 36 and the casing wall, for continuous free feeding motion of the chains as required for lowering of the anchor assembly 10 and hence also of each of the three chains 60 along the casing wall during a directional drilling operation.

The chain side plates 64 and 66 extend beyond the cylindrical blocks 62, at least on the outside of the endless chain loop, so that the side plate edges are exposed for gripping the casing wall.

As seen in FIGS. 4 and 5, the outer surface 38 of each of the elongated chain support bodies 36 has beveled sides 70 as an assurance against interference of the support bodies 36 with unobstructed, positive gripping of the casing wall by the chain side plates 64 and 66. Each of the support bodies 36 also has lead-in end guide chamfers 72 at both of its ends.

Each pair of hydraulic cylinders 32 contains a pair of pistons 74, and each of the pistons 74 has on O-ring seal 76 thereon. Flat outer head surfaces of each pair of pistons 74 engage against the flat, generally radially inwardly facing surface of a respective cylinder block recess 44, as seen in FIGS. 2 and 4. Each of the three chain support bodies 36 is retained in its operative position in the respective longitudinal trough 24 by a series of retention screws 80 which extend through generally radially oriented bores spaced along the sides of the respective support body, the screws being threadedly attached to the anchor housing 18 and having their heads slideably engaged in counterbores of the bores 78. Engagement of the screw heads against the counterbore shoulders will prevent the chain support bodies 36 from falling out of the respective troughs 24 when the anchor assembly 10 is being handled outside of a well. A pair of guide wheels 82 arranged for rotation in the longitudinal direction is supported in the anchor housing 18 adjacent both ends of each longitudinal trough 24 and its respective support body 36 to provide clearance for the outwardly exposed edges of the chain side plate lengths 64 in the retracted condition of the anchor assembly 10. This enables the chains 60 to be slightly exposed radially outwardly from the outer cylindrical surface of anchor housing 18 as seen in FIGS. 2–5 to minimize the extent of outward movement required between the retracted and extended condition of the anchor assembly 10, while nevertheless avoiding abrasion and wear of the outer edges of the side plates 64 and 66 of the chain during tripping of the anchor assembly 10 into and out of the well.

Figure 6:
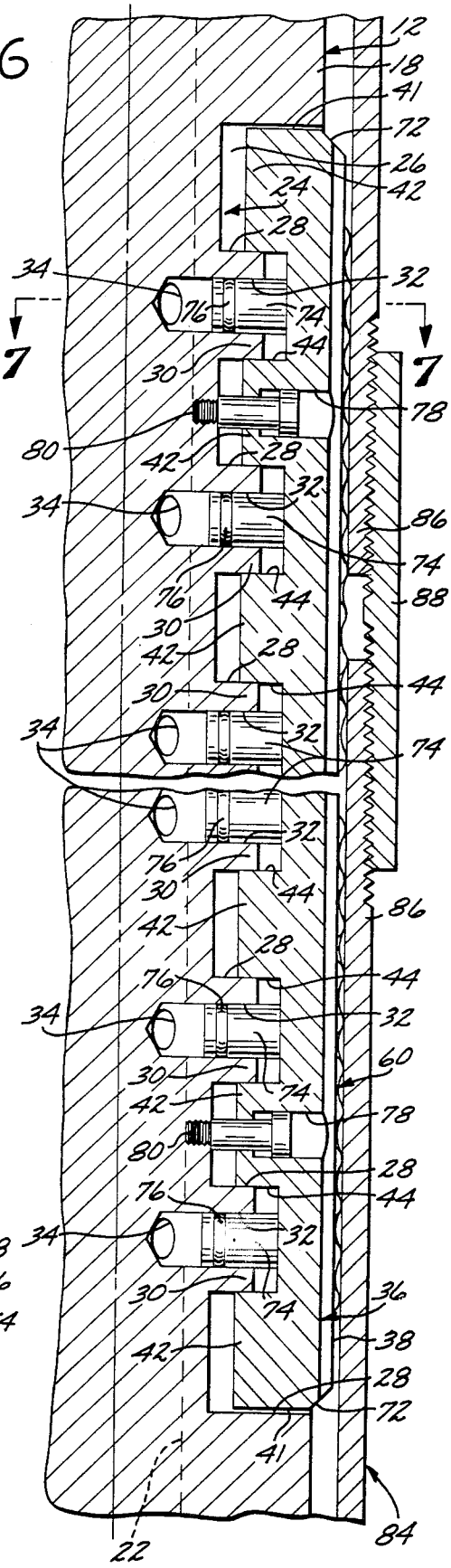
FIG. 6 is a fragmentary sectional view similar to FIG. 2, but with the anchor assembly of the present invention shown inside a well casing in its extended, actuated condition.
Figure 7:
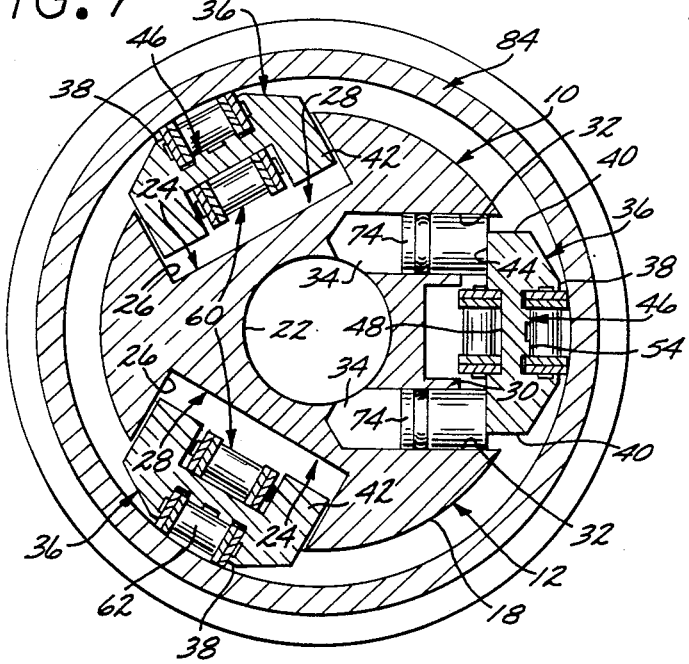
FIG. 7 is a transverse sectional view taken along line 7—7 in FIG. 6, showing the same section of the anchor assembly as shown in FIG. 4, but operatively extended and engaged against the casing wall.

FIGS. 6 and 7 illustrate the anchor assembly 10 of the invention operatively disposed within a well casing generally designated 84 made up of a series of casing sections 86 threadedly joined together by external casing joints 88. While in FIGS. 2–5 the anchor assembly 10 is shown in the unactuated, retracted condition, which is the condition in which it is tripped into and out of the well casing 84, in FIGS. 6 and 7 the anchor assembly 10 is illustrated in its actuated, extended condition in which the externally exposed length of endless chain 60 is compressed against the inside wall of casing 84 so as to lock the anchor assembly 10, and that portion of the drill string below anchor assembly 10 employed during a directional drilling operation, against azimuthal shifting from the intended and established drilling direction. It is the chain side plates 64 and 66 which actually engage against the casing wall, and the exposed edges of side plates 64 and 66 are sufficiently thin to actually bite into the casing wall so as to positively lock the anchor assembly 10 against any rotational travel. Extension of the chain support bodies 36 and chains 60 from the unactuated, retracted positions of FIGS. 1–5 to the actuated, extended positions of FIGS. 6–7 is caused by the pressure of hydraulic fluid or mud which flows downwardly through fluid circulation passage 22 to the mud motor below anchor assembly 10 which drives the drill bit, the fluid pressure being supplied from fluid circulation passage 22 through ports 34 to the hydraulic cylinders 32 and hence against the undersides of pistons 74. With the anchor assembly 10 of the present invention operatively interpolated in the drill string, hydraulic pressure inside the drill string and hence inside the fluid circulation passage 22 sufficient for the downhole mud motor to turn the drill bit is applied before the drill bit makes contact with the strata or casing that the bit is to bore out. This same hydraulic pressure radially actuates and extends the chain support bodies 36 to the extended gripping or locking position illustrated in FIGS. 6 and 7 before the drill bit makes contact with the strata, thereby locking the drill string against rotation near its downhole end before reactive torque is exerted upon the drill bit by the strata being drilled. The downhole mud motor applies torque to the drill bit once the bit is engaged in the strata according to the amount of hydraulic pressure transmitted by the fluid in the drill string as the fluid is pumped down through the drill string from the surface. Consequently, the reactive torque upon the drill bit and thus the drill string which would normally cause azimuthal drift in the direction of drilling also varies with the hydraulic pressure of the fluid in the drill string. Since the hydraulic pressure along the drill string is everywhere substantially the same, the hydraulic pressure exerted upon the pistons 74 of anchor assembly 10 is substantially equal to the hydraulic pressure transmitted to and powering the downhole mud motor. Therefore, as hydraulic pressure increases and reactive torque which would otherwise tend to cause azimuthal drift in the direction of drilling proportionally increases, the force of engagement of the anchor chains 60 against the casing wall which locks the drill string against azimuthal drift also substantially proportionately increases.

With the endless locking chains 60 engaged against the wall of casing 84 as seen in FIGS. 6 and 7, as the anchor assembly 10 travels downwardly in the casing during a directional drilling operation, new links of side plates 64 and 66 are continuously fed out through the lower arcuate chain track recess 50 into operative engagement with the casing 84, and each new link of side plates 64 and 66 is enabled to remain in fixed position against the casing wall during an entire length of travel of the exposed part of the respective chain 60 until that link is scooped back into the inside track part of the respective chain support body through the upper arcuate end recess 50. Thus, each link of side plates 64 and 66 tends to become forced increasingly deeper into biting engagement with the casing wall under the continuing pressure applied by pistons 74 during the entire distance of travel of anchor assembly 10 downwardly for the vertical span between the lower and upper arcuate recesses 50. In this manner, for each chain 60 a large number of links of side plates 64 and 66 is always in static biting contact against the casing wall along the entire exposed chain length between the upper and lower arcuate end recesses 50 at all times during a directional drilling operation despite continuous downward vertical travel of the anchor assembly 10 in the casing for any distance. Such static gripping over an extended length of the tool does not allow any rotational travel whatsoever such as applicant has found to be inevitable with the continuously moving dynamic contact which occurs when rotating wheels have been engaged against the casing wall in attempts to secure directional drill strings against azimuthal drift caused by reactive torque.

With the well casing sections 86 held together in vertical series by the external casing joints 88 as illustrated in FIG. 6, there is frequently a gap 90 inadvertently left between two casing sections 86. Such gap 90 would generally leave portions of only one or at most two links of side plates 64 and 66 in a nongripping condition as indicated in FIG. 6, but this would not in any way adversely affect the operation of anchor assembly 10 because of the many links of side plates 64 and 66 which are in gripping engagement with the casing wall along the entire length of chains 60.

The chains 60 will remain in positive gripping engagement with the casing wall during an entire drilling sequence until the mud pressure is relieved from the drill string and torque thereby relieved from the string. Then, upward tripping of the anchor assembly 10 in the drill string will cause the chains 60 and their support bodies 36 to automatically retract to the unactuated positions shown in FIGS. 2–5 by bumping of the chains against the casing wall, and then any further lateral bumping will be taken up by the guide wheels 82. The chains 60 and their support bodies 36 will similarly automatically assume or remain in the retracted position of FIGS. 2–5 during downward tripping of the drill string, since no mud pressure is applied at that time.

Figure 8:
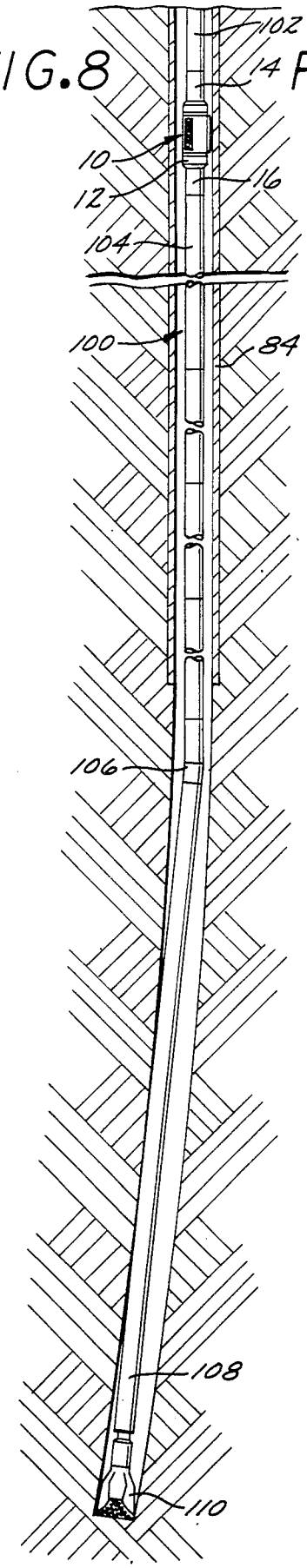
FIG. 8 is a side elevational view of the invention in conjunction with a conventional drill string and downhole mud motor operatively located in a well that is shown in fragmentary vertical section, the drilling procedure illustrated in this figure involving either correction of the azimuth of a directional drill string or initiation of a deviation from the vertical where, in either case, the drill bit extends below the well casing.
Figure 9:
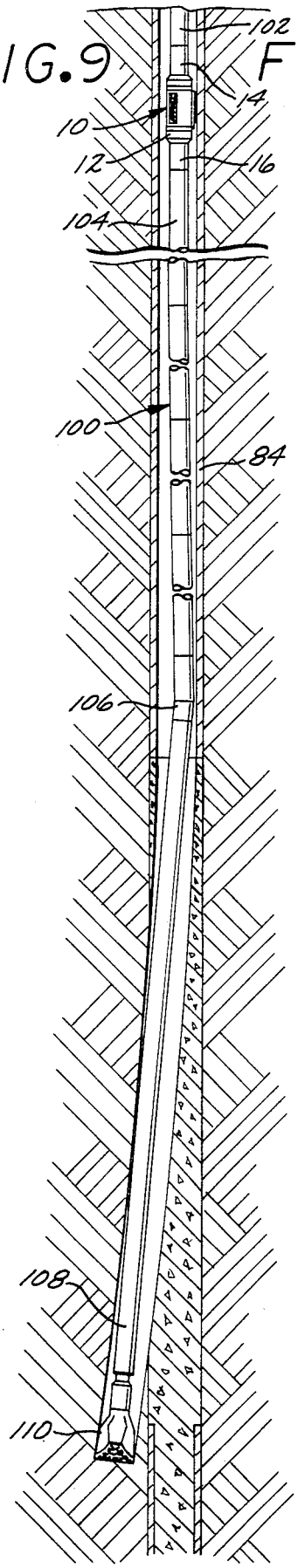
FIG. 9 is a view similar to FIG. 8, but the drilling procedure illustrated in this figure involves drilling out of a cement plug which fills a drilled-out casing section, the bit having drilled through the cement plug and proceeding in the desired azimuthal direction.
Figure 10:
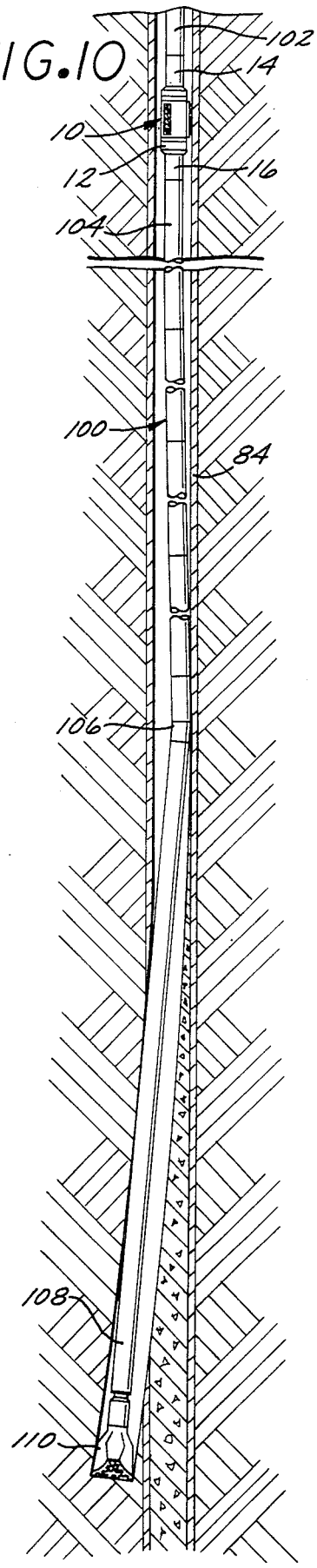
FIG. 10 is a view similar to FIGS. 8 and 9, but the drilling procedure illustrated in this figure involves filling a casing section with a cement plug and then milling through both cement plug and casing wall.

The configuration of anchor assembly 10 enables it to be interpolated into a conventional drill string 100, as illustrated in FIGS. 8–10. The tool joints at the free ends of respective upper and lower coupling sections 14 and 16 are made compatible with equivalent tool joints in a drill pipe section 102 and drill collars 104. The sections of drill pipe 102 and drill collars 104 are themselves interchangeable in the drill string 100, the heavier drill collars 104 being used to maintain tension in the drill string 100 by adding weight near its downhole end. The coupling sections 14 and 16 of anchor pipe 12 are preferably of the same diameter as a conventional drill collar 104.

The anchor assembly 10 of the present invention is interpolated into a drill string 100 near the downhole end when in use. Below the anchor assembly 10, at the bottom of drill string 100, the drill bit 110 is driven by a downhole motor 108, both of which are held at a given angle of deviation from the vertical by a bent sub 106. The downhole mud motor 108 is driven by the hydraulic pressure in the hydraulic drilling fluid or mud, which is pumped down through the pipe sections of the drill string 100 and through the fluid circulation passage 22 in anchor pipe 12.

After the vertical shaft of a well has been drilled out, it is common drilling procedure to secure the shaft by cementing well casing sections 86 into place continuously along the shaft. Once set, the well casing 84 thus formed becomes substantially more stable and immovable than the surrounding strata. It is this casing against which the gripping chains 60 become locked during operation of the present invention as described above. Once the casing 84 is set into the shaft, directional drilling may be initiated along an angle of deviation from the vertical by interpolating the downhole mud motor 108 and bent sub 106 between the drill bit 110 and lowermost drill collar 104. The directional drilling will proceed along a curved deviation from the vertical toward a predetermined target. The bent sub 106 is selected according to the degree of deviation per footage of drilling which is desired (e.g., 0.01 degrees/foot, etc.).

The anchor assembly 10 of the present invention will generally be used between two drill collars 104 since these collars, being of greater weight than the sections of drill pipe 102, are conventionally situated as closely as possible to the mud motor 108 and drill bit 110 in order to maintain tension in the drill string 100. The invention is not intended for use below the well casing 84 or in an otherwise open hole, since the gripping chains 60 would not normally be able to achieve a positive purchase on the strata surrounding the well shaft. The proximity of the anchor assembly 10 to the bent sub 106 allowable in the system of the present invention marks one of its chief advantages over surface located devices such as the rotary table of the kelly device. With a drill string 100 of great length, no surface holding device is capable of preventing a substantial amount of directional (azimuthal) drift at the downhole end. The anchor assembly 10 of the invention, on the other hand, may be located close to the bent sub 106, thereby absorbing the reactive torque as efficiently as possible.

No surface rotational holding device is needed in conjunction with the anchor assembly 10.

As indicated above, a feature of the present invention which cooperates with the very close placement of anchor assembly 10 to the bent sub 106 is its self-adjusting nature to provide as much gripping force as is required to positively lock against rotational travel regardless of the amount of reactive torque on the drill string. As the reactive torque 100 increases, so does the pressure of the hydraulic drilling fluid, so that the gripping chains 60 more tightly grip the well casing 84, providing a substantially proportionate increase in the locking force against reactive torque.

Since the work done by the anchor assembly 10 occurs entirely downhole, an entire 90-foot stand of drill pipe (the conventional maximum height of drill stand) with a hydraulic hose attached to its top may be drilled in a single operation, whereas the current use of the kelly device requires that 30-foot sections of drill pipe 102 be added in order to readjust the grip of that device on the drill string 100. In an attempt to compensate for this inadequacy and save expensive drilling time, drilling operations are commonly overextended with the kelly device by drilling down as much as 44 feet and then adding a 30-foot section of drill pipe 102, necessarily regripping the drill string with the drill bit off the bottom of the well. This procedure introduces a significant error in the azimuthal orientation of the drill bit.

FIGS. 8–10 illustrate some common drilling procedures in conjunction with the present invention. One of the advantages of directional drilling is the capability of accessing a number of different deposits from one central vertical well shaft. In terms of drilling procedure, this means that several deviations from the vertical must be made at varying depths along the well shaft. In FIG. 8, directional drilling is initiated or corrected below the well casing 84. FIG. 9 illustrates the initiation of a deviation from the vertical higher in the well shaft. In the procedure depicted in FIG. 9, a vertical length of casing is milled out and a cement plug 116 is then pumped in so as to provide the drill bit 110 with a more substantial and uniform bite as it exits the previously drilled vertical shaft. Without the cement plug 116, the drill bit 110 would tend to chatter against the side of the casing. The procedure illustrated in FIG. 10 has eliminated the step of premilling a section of the casing. The drill string 100 is tripped out of the shaft and the cement plug 116 pumped into place. The drill bit 110 then mills through both the plug 116 and casing 84.

The proper use of the present invention greatly reduces the need for directional monitoring by survey devices. It is inevitable, however, that occasionally it should be desirable to send downhole a survey probe. The present invention makes no restriction on this procedure, since the anchor assembly 10 may be made entirely from a nonmagnetic metal such as stainless steel or brass in order not to interfere with the operation of the survey device.

The annular frustoconical guide chamfers 20 prevent the radial enlargement of anchor housing 18 from catching in any gaps between the casing sections 86 during either the in-tripping or out-tripping of the drill string 100, and similarly, the end guide chamfers 72 on chain support bodies 36 prevent the bodies 36 from catching in any casing gaps when the bodies 36 are first extended.

The construction of the anchor assembly 10 permits easy dismantlement of the chain support bodies 36 with their chains 60 for maintenance purposes by simply removing the retention screws 80.

While the present invention has been described with reference to a presently preferred embodiment, it is to be understood that various modifications may be made by those skilled in the art without departing from the scope and spirit of the invention as set forth in the appended claims.

I claim:

1. A downhole anchor assembly for absorbing reaction torque from a downhole mud motor in a directional drill string so as to minimize azimuthal deviation from such reaction torque, said anchor assembly comprising:

an elongated, generally cylindrical housing having upper and lower ends with tool joints thereon for coupling said body into a directional drill string and having a drilling fluid passage extending longitudinally through its length;

at least one elongated chain support body longitudinally mounted in said housing;

an elongated, endless anchor chain supported on said body, said chain having an elongated portion thereof longitudinally arranged and generally radially exposed externally of said body, said exposed chain portion being freely longitudinally movable along said body;

said body being generally radially shiftable between a retracted position in which said exposed chain portion is substantially recessed in said housing and an extended position in which said exposed chain portion extends generally radially outwardly from said housing so as to be engageable along its exposed length against a well casing; and actuating means in said housing engageable with said body for shifting said body from its said retracted position to its said extended position, said actuating means exerting generally radially outwardly directed force on said body for forceable engagement of said exposed chain portion against a well casing.

2. An anchor assembly as defined in claim 1, wherein said actuating means is actuated by hydraulic fluid pressure of drilling fluid in said passage.

3. An anchor assembly as defined in claim 2, wherein said actuating means comprises hydraulic cylinder means in said housing in fluid communication with said passage, and piston means in said cylinder means and engageable with said body.

4. An anchor assembly as defined in claim 3, wherein said cylinder means comprises a plurality of cylinders longitudinally spaced in said housing and said piston means comprises a piston in each of said cylinders.

5. An anchor assembly as defined in claim 3, wherein said cylinder means comprises a plurality of pairs of cylinders longitudinally spaced in said housing and said piston means comprises a piston in each of said cylinders, each of said pairs of cylinders comprising a cylinder on each circumferential side of said chain.

6. An anchor assembly as defined in claim 2, wherein said actuating means exerts a generally radially outwardly directed force on said body that is substantially proportional to said hydraulic fluid pressure, whereby as increased hydraulic pressure causes increased mud motor reaction torque there will be a substantially proportional increase of the gripping force of said exposed chain portion against the well casing.

7. An anchor assembly as defined in claim 2 which comprises a plurality of said chain support bodies and respective endless chains substantially evenly circumferentially spaced around said housing.

8. An anchor assembly as defined in claim 7 which comprises three of said chain support bodies and respective endless chains.

9. An anchor assembly as defined in claim 2, wherein said chain is a block chain.

10. An anchor assembly as defined in claim 9, wherein the edges of the side plates of said block chain extend radially outwardly beyond the blocks of said chain in said exposed chain portion so that said side plates will grip a casing wall.

11. An anchor assembly as defined in claim 9, wherein the blocks of said block chain are cylindrical and freely rotatable on respective pins of the chain, and an elongated, generally radially outwardly facing bearing track on said body along which said chain blocks of said exposed chain portion roll.

12. An anchor assembly as defined in claim 9 which comprises a plurality of said chain support bodies and respective endless chains substantially evenly circumferentially spaced around said housing.

13. An anchor assembly as defined in claim 12 which comprises three of said chain support bodies and respective endless chains.

14. An anchor assembly as defined in claim 10 which comprises a plurality of said chain support bodies and respective endless chains substantially evenly circumferentially spaced around said housing.

15. An anchor assembly as defined in claim 14 which comprises three of said chain support bodies and respective endless chains.

16. An anchor assembly as defined in claim 11 which comprises a plurality of said chain support bodies and respective endless chains substantially evenly circumferentially spaced around said housing.

17. An anchor assembly as defined in claim 16 which comprises three of said chain support bodies and respective endless chains.

18. An anchor assembly as defined in claim 17, wherein said actuating means comprises hydraulic cylinder means in said housing in fluid communication with said passage, and piston means in said cylinder means and engageable with said body.

19. An anchor assembly as defined in claim 18, wherein said actuating means exerts a generally radially outwardly directed force on said body that is substantially proportional to said hydraulic fluid pressure, whereby as increased hydraulic pressure causes increased mud motor reaction torque there will be a substantially proportional increase of the gripping force of said exposed chain portion against the well casing.

* * * * *